US009539601B2

(12) United States Patent
Ruha

(10) Patent No.: US 9,539,601 B2
(45) Date of Patent: Jan. 10, 2017

(54) SHIELD DEVICE WITH PIVOTABLE HANDLE AND METHOD OF USE

(71) Applicant: WARNER MANUFACTURING COMPANY, Minneapolis, MN (US)

(72) Inventor: David J. Ruha, New Hope, MN (US)

(73) Assignee: WARNER MANUFACTURING COMPANY, Plymouth, MN (US)

( * ) Notice: Subject to any disclaimer, the term of this patent is extended or adjusted under 35 U.S.C. 154(b) by 112 days.

(21) Appl. No.: 14/166,342

(22) Filed: Jan. 28, 2014

(65) Prior Publication Data

US 2014/0209019 A1 Jul. 31, 2014

Related U.S. Application Data

(60) Provisional application No. 61/757,413, filed on Jan. 28, 2013.

(51) Int. Cl.

| | |
|---|---|
| ***E04F 21/00*** | (2006.01) |
| ***B05B 15/04*** | (2006.01) |
| ***E04F 21/02*** | (2006.01) |
| *B05C 21/00* | (2006.01) |

(52) U.S. Cl.

CPC ..... *B05B 15/04* (2013.01); *B05B 15/045* (2013.01); *E04F 21/02* (2013.01); *B05C 21/005* (2013.01)

(58) Field of Classification Search

CPC ..... E04F 21/02; B05C 21/005; B05B 15/04; B05B 15/045

USPC ..... 118/504, 505

See application file for complete search history.

(56) References Cited

U.S. PATENT DOCUMENTS

| | | | | |
|---|---|---|---|---|
| 4,574,731 | A * | 3/1986 | Stevens | B05B 15/0475 118/504 |
| 4,962,722 | A * | 10/1990 | Thompson | B05B 15/0475 118/504 |
| 5,103,762 | A * | 4/1992 | Long | B05B 15/0475 118/504 |
| 2008/0092811 | A1* | 4/2008 | Kim | B05C 21/005 118/504 |
| 2010/0126416 | A1* | 5/2010 | Gringer | B05B 15/0475 118/504 |

* cited by examiner

*Primary Examiner* — Laura Edwards

(74) *Attorney, Agent, or Firm* — Hamre, Schumann, Mueller & Larson, P.C.

(57) ABSTRACT

A shield device helps prevent selected surface areas from being painted by a paint material. The shield device includes a sheet member; and a handle member pivotable in a plane defined by the sheet member. The shield device is arranged between a folded configuration where the handle member is positioned generally parallel to an attachment edge of the sheet member, and an unfolded configuration, and an unfolded position.

9 Claims, 9 Drawing Sheets

SHIELD DEVICE WITH PIVOTABLE HANDLE AND METHOD OF USE

FIELD

This disclosure relates generally to dry wall tools, such as a shield device for protecting selected surface areas from being oversprayed by a spray material.

BACKGROUND

During the application of paint, adhesives, architectural texturizing materials, or similar materials to construction surface areas, such as walls, ceilings, window panes, doors, or the like, unintended surfaces need to be protected from overspray, splatters, or like contamination. Methods of protecting unintended surface areas from being oversprayed are taping or laying sheets of paper, cloth, or plastic or using a conventional spray shield to protect the unintended surface areas from being oversprayed.

SUMMARY

Some embodiments of a shield device include a sheet member and a handle member pivotable in a plane defined by the sheet member. The shield device can be arranged between a first configuration for storage, transport and display, and a second configuration for use. For example, the shield device may be arranged in a folded configuration (e.g., when stored in a warehouse room, when stored during transport, when displayed at retail, or the like) where the handle member is positioned generally parallel to the sheet member, thereby conserving storage space and display shelf space and avoiding misplacement of the handle member. Moreover, the shield device may be arranged in an unfolded configuration (e.g., when used at a work site). In such circumstances, the handle member may be positioned at a generally perpendicular position relative to the sheet member to allow the user to spray at locations such as directly above his or her body, and positioned at one or more non-perpendicular positions relative to the sheet member to allow the user to extend his or her reach sideways from his or her body to spray into such as corners.

In some embodiments, a shield device can help protect selected surface areas from being painted by a paint material. The shield device includes a sheet member; and a handle member pivotable in a plane defined by the sheet member. The shield device is arranged between a folded configuration where the handle member is positioned generally parallel to an attachment edge of the sheet member, and an unfolded configuration, and an unfolded position.

In other embodiments, a method for making a shield device includes a sheet member and a handle member pivotable within a plane defined by the sheet member. The handle member has a first clamping member and a second clamping member for clamping on an attachment edge of the sheet member. The method includes molding the handle member without using a core pull.

These and other embodiments described herein may provide one or more of the following benefits. First, some embodiments of the shield device can be arranged between a first configuration for storage, transport and display and a second configuration for use. For example, when the shield device is arranged in first configuration, the handle member of the shield device can be positioned generally parallel relative to the sheet member, thereby conserving storage space and display shelf space and avoiding misplacement of the handle member. Second, when the shield device is arranged in a second configuration, the handle member may be positioned at a generally perpendicular position relative to the sheet member to allow the user to spray at locations such as directly above his or her body, and positioned at one or more non-perpendicular positions relative to the sheet member to allow the user to extend his or her reach sideways from his or her body to spray into such as corners.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference symbols in the various drawings indicate like elements.

DETAILED DESCRIPTION

Figure 1A:
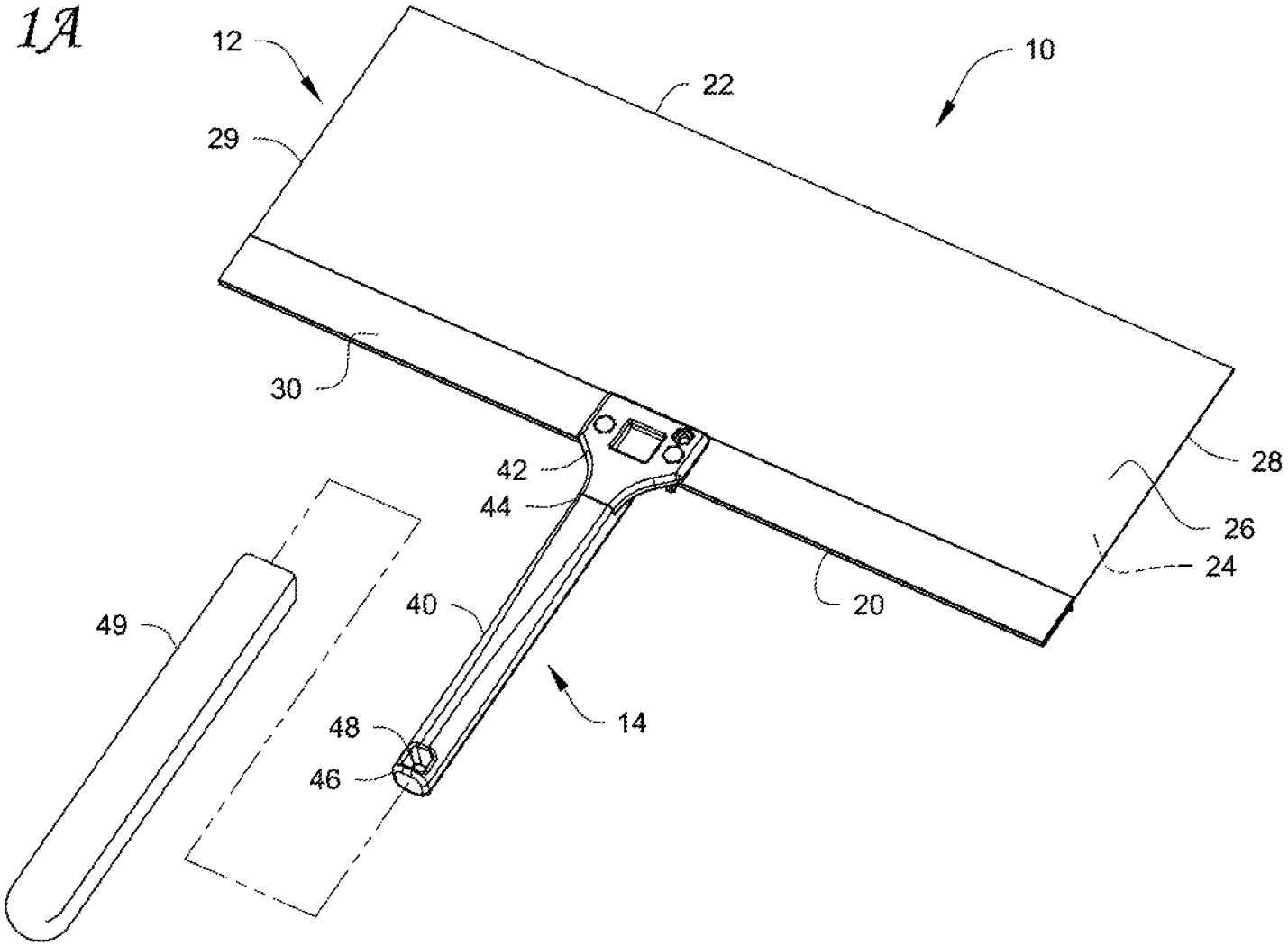
FIG. 1A is a perspective view of a shield device.
Figure 4:
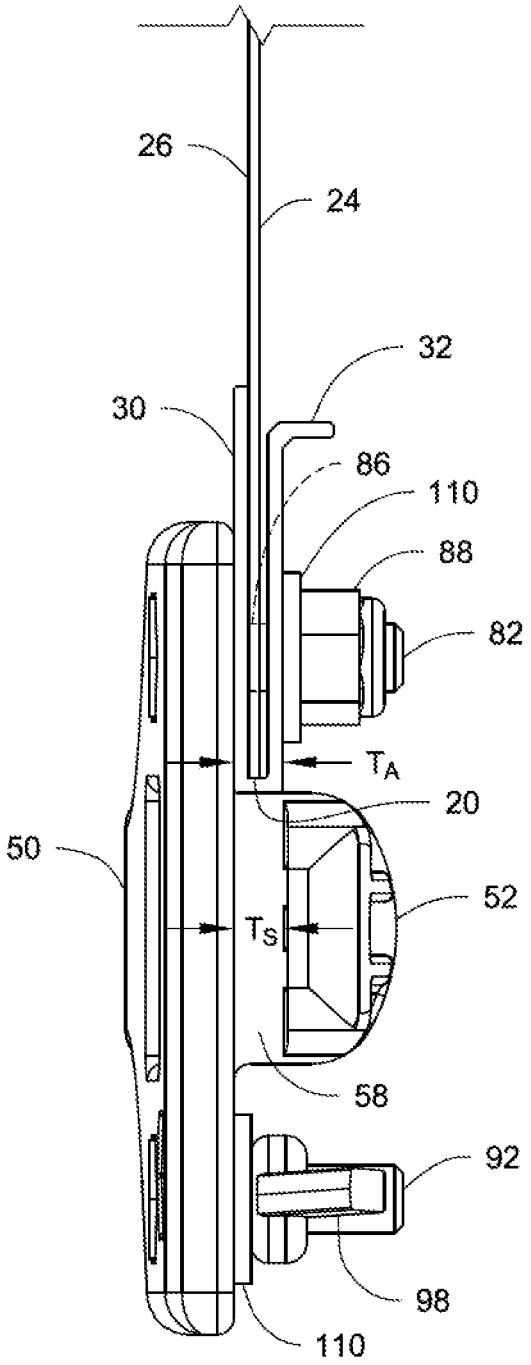
FIG. 4 is a partial left side view of the shield device of FIG. 3.

Referring to FIGS. 1A and 4, a shield device 10 is configured for protecting selected surface areas from being oversprayed by a spray material. The shield device 10 includes a sheet member 12 and a handle member 14 pivotable in a plane defined by the sheet member 12. The shield device 10 may be arranged in a folded configuration, e.g., when stored in a warehouse room, when stored during transport, when displayed at retail, or the like) where the handle member 14 is positioned generally parallel to an attachment edge 20 of the sheet member 12, thereby conserving storage space and display shelf space and avoiding misplacement of the handle member 14. Moreover, the shield device 10 may be arranged in an unfolded configuration (e.g., when used at a work site). In such circumstances, the handle member 14 may be positioned at a generally perpendicular position relative to the attachment edge 20 of the sheet member 12, or at one or more non-perpendicular positions relative to the attachment edge 20.

The shield device 10 can be configured to shield a building's wall, ceiling, or equivalent surface from overspray, splattering, or like occurrence during the application of a spray material, such as paint, sealant, texturizer compound, or similar materials, to a desired area. Therefore, the shield device 10 can help protect selected surface areas from being oversprayed.

Still referring to FIGS. 1A and 4, the sheet member 12 is generally a flat, rectangular sheet material. The sheet member 12 includes a distal, leading edge 22 for pressing against a wall to protect a selected surface area against overspray, and a proximal, attachment edge 20 that provides an attachment point for connection with the handle member 14. The sheet member 12 also includes a front face 24, a rear face 26, and first and second ends 28, 29. It is to be understood that although, as shown in FIG. 1A, it is depicted in a rectangular shape, the sheet member 12 can take other shapes, such as square, circular, or the like.

Suitable materials for fabricating the sheet member 12 include light weight material, such as plastic, rubbers, thin aluminum or stainless steel, woods, cardboard, or the like. Preferably, the sheet member 12 is made of a material that has a degree of flexibility.

The sheet member 12 can be constructed with a length ranging from 18"-48" from the first end 28 to the second end 29, and 12"-24" from the leading edge 22 to the attachment edge 20. However, it should be understood that different lengths or widths may be utilized.

Still referring to FIGS. 1A and 4, optionally, the attachment edge 20 of the sheet member 12 may include a reinforcing element 30 for enhancing the structural rigidity of the attachment edge 20 and preventing excessive spray material from running down the sheet member 12 toward the user during use. In the depicted embodiment as shown in FIG. 1A, the reinforcing element 30 is in a U shape for wrapping around the attachment edge 20 of the sheet member 12. An edge of the reinforcing element 30 that is formed adjacent the front face of the sheet member 12 extends away from the front face, forming a lateral flange 32 (referring to FIG. 4). The reinforcing element 30 can be fastened to the sheet member 12 by suitable fastening mechanisms. Alternatively, the reinforcing element 30 may be formed by bending the sheet member 12 upon itself over the front face with a flange extending away from the front face 24.

Figure 1B:
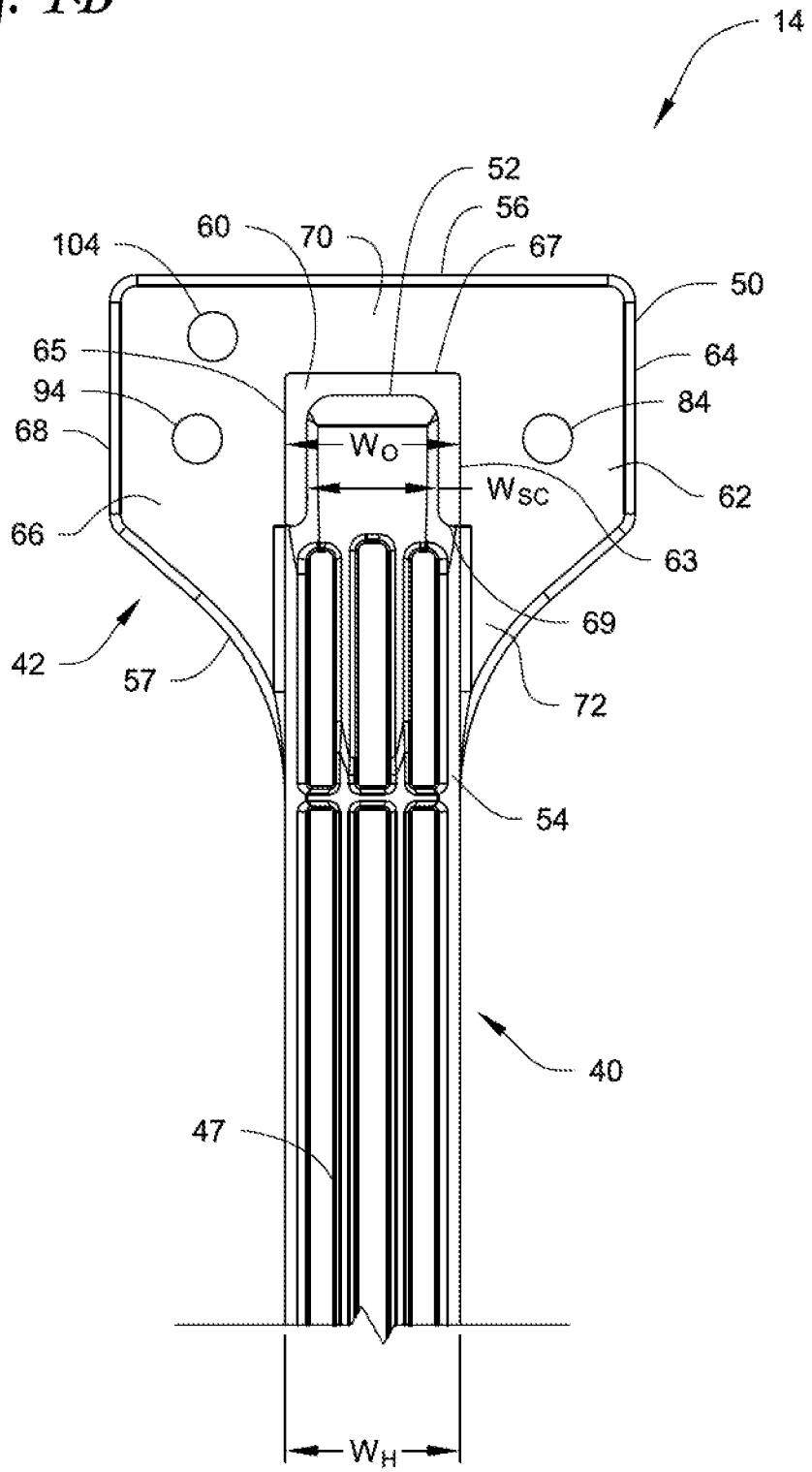
FIG. 1B is a partial front view of the handle member of the shield device of FIG. 1A.
Figure 2:
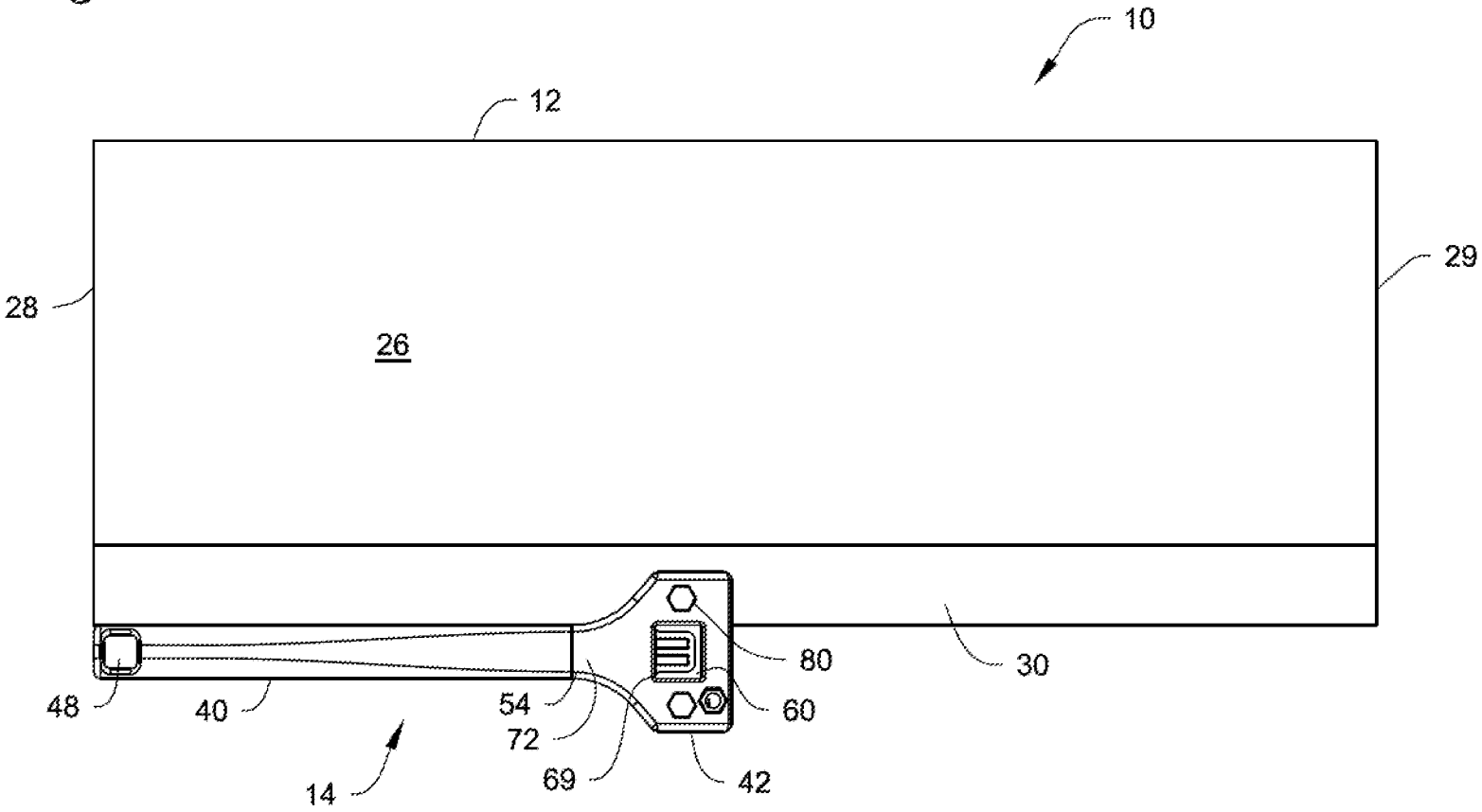
FIG. 2 is a front view of the shield device of FIG. 1 arranged in a first configuration.
Figure 3:
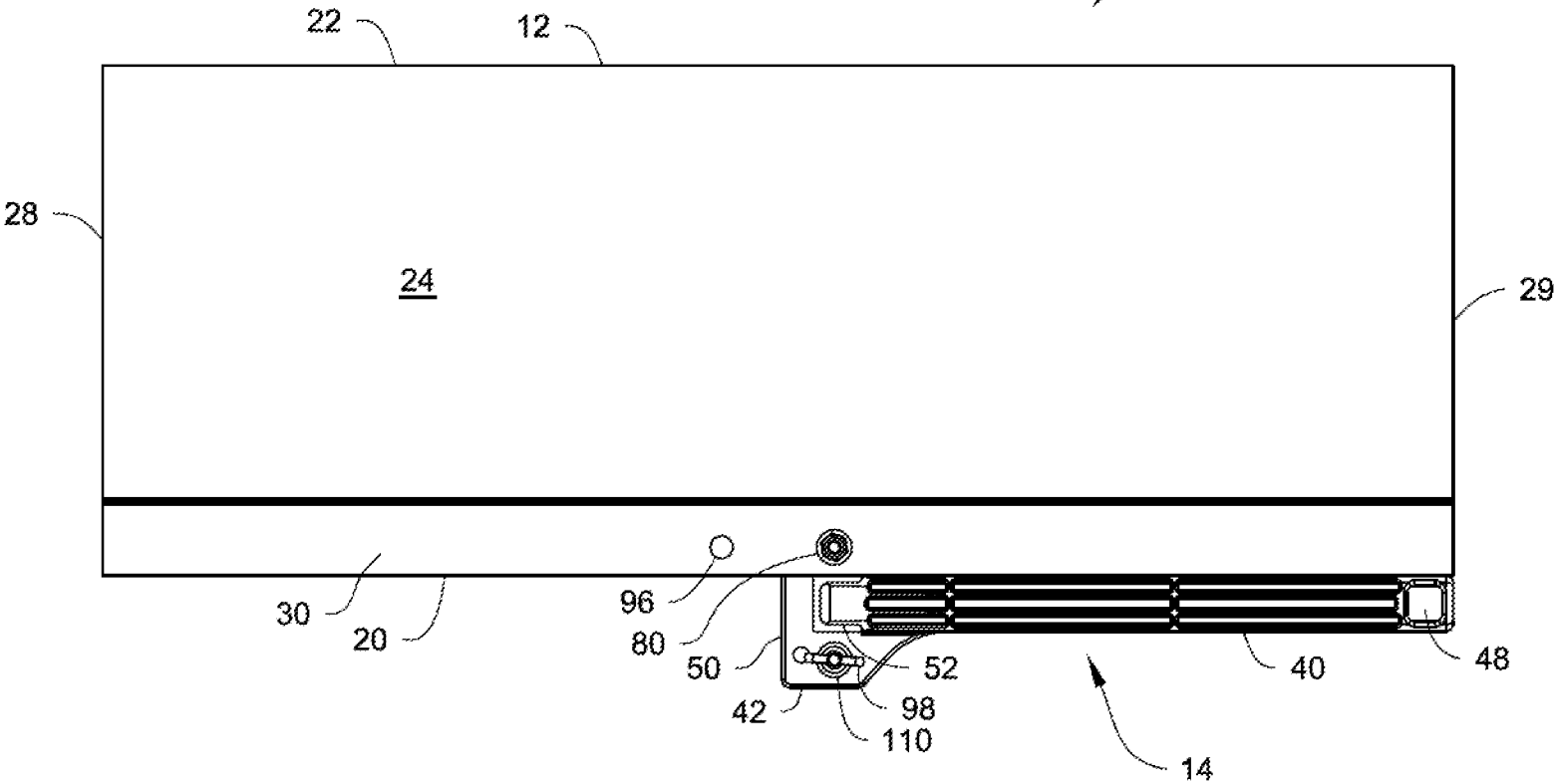
FIG. 3 is a rear view of the shield device of FIG. 2.

Referring now to FIGS. 1A-B, the handle member 14 of the shield device 10 may include a handle body 40 and a connection element 42 for connecting the handle member 14 to the attachment edge 20 of the sheet member 12. The handle body 40 includes a distal end 44 connected to the connection element 42 and a proximal end 46 positioned opposite to the distal end 44. The handle member 14 can be constructed of various suitable materials, such as plastic, metal, wood, or the like. For example, the handle body 40 can be a thin wall structure 47 formed by injection molding.

The handle member 14 is constructed with a sufficient length to permit the user to hold the shield device 10 with one hand and manipulate a spray gun with the other hand. For example, in some embodiment, the handle member 14 may have a length ranging from 12" to 24" for reaching various surface areas. Optionally, a hole 48 can be constructed in the handle body 40 adjacent the proximal end 46 for hanging the shield device 10.

Optionally, an extension handle 49 may be attached to the proximal end of the handle body 40 for reaching a surface that is not within the range of reach by a regular handle member 14. For example, the handle body 40 may have a threaded aperture defined in its proximal end 46 such that an extension handle 49 having one end constructed with corresponding threads can be twisted tightly into the aperture. It is to be understood that other suitable fastening mechanisms can be used to attach the extension handle 49 to the proximal end 46 of the handle member 14, such as snap-fit connection.

Referring to FIGS. 1A-B and 4, the connection element 42 is configured to connect the handle member 14 to the sheet member 12 and is pivotable in a plane defined by the sheet member 12. The connection element 42 includes a proximal end 54 for connection with the distal end 44 of the handle body 40, and a distal end 56 opposite to the proximal end 54. The connection element 42 has a width that is greater than the width $W_H$ of the handle body 40. The width of the connection element 42 is narrowed in the curved area 57 when extending toward the proximal end 54.

In the depicted embodiment, the connection element 40 is constructed integral with the handle member 14. However, it is to be understood that the connection element 40 may be constructed as a separate structural member. In such circumstances, the handle member 14 can be mounted to the connection element 40 by a suitable fastening mechanism, such as a threaded connection.

A first clamping member 50 extends between the proximal end 54 and the distal end 56 for clamping on the rear face 26 of the sheet member 12. A second clamping member 52 is formed across the thickness of the connection element 42 relative to the first clamping member 50 for clamping on the front face 24 of the sheet member 12. The second clamping member 52 extends from the proximal end 54 of the connection element 42 toward the distal end 56. A slot 58 is formed between the first and second clamping members 50, 52 for receiving the attachment edge 20 of the sheet member 12. In some embodiments, a thickness $T_S$ of the slot 58 is slightly smaller than a thickness $T_A$ of the attachment edge 20 of the sheet member 12 such that when the attachment edge 20 is received in the slot 58, an interference fit is formed between an inner surface of the slot 58 and an outer surface of the attachment edge 20 create a tight connection.

Referring to FIGS. 1A-B, in the depicted embodiment, the first clamping member 50 is generally a flattened rectangular plate. It is to be understood that other equivalent shapes, either flattened or not, are contemplated by this disclosure, such as square, circular, elliptical, triangular, or the like. The first clamping member 50 includes an opening 60, a first side portion 62 formed between a first edge 63 of the opening 60 and a first side edge 64 of the first clamping member 50, a second side portion 66 formed between a second edge 65 of the opening 60 and a second side edge 68 of the first clamping member 50, a distal side 70 formed between a distal edge 67 of the opening 60 and the distal end 56 of the connection element 42, and a proximal side 72 formed between a proximal edge 69 of the opening 60 and the proximal end 54 of the connection element 42.

In the depicted embodiment as shown in FIGS. 1A-B, the opening 60 has a same width $W_O$ as the handle body 40 (which has a width of $W_H$). However, it is to be understood that the opening 60 can also have a width $W_O$ that is greater than the width $W_H$ of the handle body 40 as long as adequate structure strength is maintained. The opening 60 can also have a width $W_O$ that is smaller than the width $W_H$ of the handle body 40 as long as it does not limit the size of the second clamping member 52 to be too small to support the sheet member 12.

Referring to FIGS. 1A-B, in the depicted embodiment, the second clamping member 52 has a contour corresponding to an inner contour (formed by edges 63, 65, 67) of the opening 60. For example, the second clamping member 52 can have a contour that is slightly smaller than the inner contour of the opening 60. This allows the connection element 42 to be molded without using a core pull during a molding process. It is to be understood that a height $H_{SC}$ of the second clamping member 52 (referring to FIG. 6) can be equal of greater than ⅓ of the height $H_R$ of the reinforcement element 30 to allow adequate support to be provided to the front face 24 of the sheet member 12. It is to be understood that although in FIGS. 5-9 the second clamping member 52 is depicted as clamping on the front face 24 of the sheet member 12, the second clamping member 52 can instead be configured to clamp on the rear face 26 of the sheet member 12, while the first clamping member 50 is configured to clamp on the first face 24 side of the attachment edge 20.

It is to be understood that the second clamping member 52 can take other equivalent shapes, either flattened or not, are contemplated by this disclosure, such as square, circular, elliptical, triangular, or the like, as long as its contour is sized smaller than the inner contour of the opening 60 defined in the first clamping member 50.

Referring now to FIGS. 1B and 2-4, in some embodiments, the second clamping member 52 has a maximum width that is smaller than the width of the distal end 44 of the handle body 40, thereby allowing the shield device 10 to be arranged in a folded configuration (e.g., when stored in a warehouse room, when stored during transport, when displayed at retail, or the like) where the handle member 14 is positioned generally parallel to the sheet member 12, thereby conserving storage space and display shelf space and avoiding misplacement of the handle member 14.

Still referring to FIGS. 1B and 2-4, in some embodiments, the second clamping member 52 has a constant width $W_{SC}$, and the handle body 40 also has a constant width $W_H$, where the constant width $W_{SC}$ of the second clamping member 52 is smaller than the constant width $W_H$ of the handle body 40, thereby allowing the shield device 10 to be arranged in a folded configuration where the handle member 14 is positioned generally parallel to the sheet member 12.

Still referring to FIGS. 1B and 2-4, in some embodiments, the second clamping member 52 has a constant width $W_{SC}$, and the constant width $W_{SC}$ is smaller than the width of the distal end 44 of the handle body 40. This allows the shield device 10 to be arranged in a folded configuration where the handle member 14 is positioned generally parallel to the sheet member 12.

Still referring to FIGS. 1B and 2-4, in some embodiments, the second clamping member 52 has a maximum width, and the handle body 40 has a constant width $W_H$, where the maximum width of the second clamping member 52 is smaller than the constant width $W_H$ of the handle body 40. This allows the shield device 10 to be arranged in a folded configuration where the handle member 14 is positioned generally parallel to the sheet member 12.

Referring to FIGS. 1B and 2-4, the first clamping member 50 of the connection element 42 is fastened to the attachment edge 20 by a fastener at a first attachment point 80 such that the handle member 14 is allowed to pivot freely about the first attachment point in the plane defined by the sheet member 12.

For example, as shown in FIGS. 1B and 2-4, a bolt 82 can be used to pass through a first aperture 84 defined in the first side 62 of the first clamping member 50, aligned with and passing through an aperture 86 defined in the attachment edge 20 of the sheet member 12 and fastened by a lock nut 88, thereby locking the connection element 42 in a pivotable position relative to the sheet member 12. In some embodiments, the connection element 42 is fastened to the sheet member 12 permanently at the first attachment point 80. It is to be understood that various suitable fastening mechanisms can be used to attach the connection element 42 to the attachment edge 20.

In the depicted embodiment, when arranged in the folded configuration, the connection element 42 is attached to the sheet member 12 only at the first attachment point 80. However, it is to be understood that, if desired, a second attachment point 90 can also be used to attach the connection element when in the folded configuration.

Referring now to FIGS. 1B and 5-8, the shield device 10 may be arranged in an unfolded configuration (e.g., when used at a work site). In such circumstances, the handle member 14 may be positioned perpendicular to the attachment edge 20 of the sheet member 12, or at a non-perpendicular angle relative to the attachment edge 20.

Figure 5:
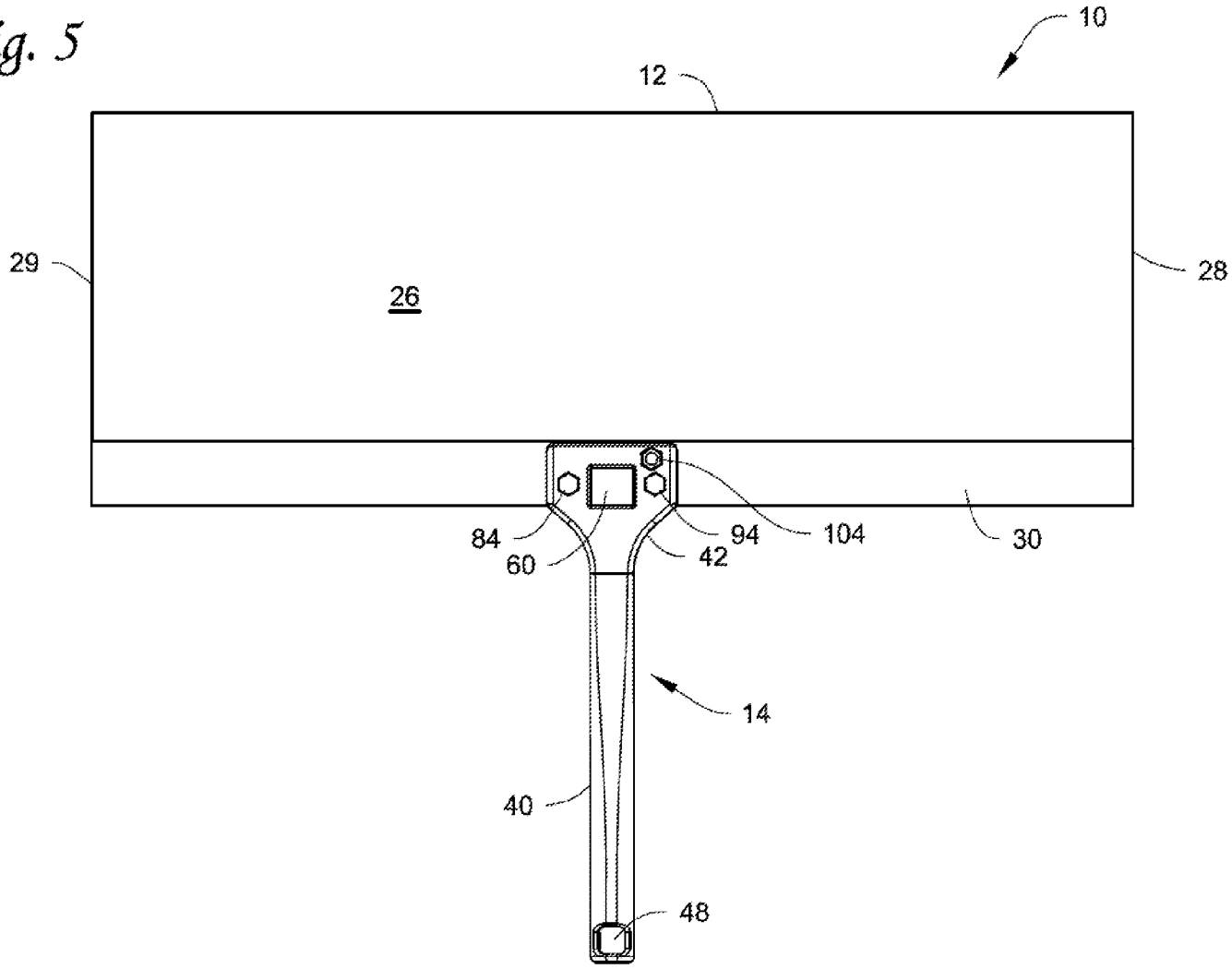
FIG. 5 is a front view of the shield device of FIG. 1, with a handle member being positioned in a first position, when the shield device is arranged in a second configuration.
Figure 6:
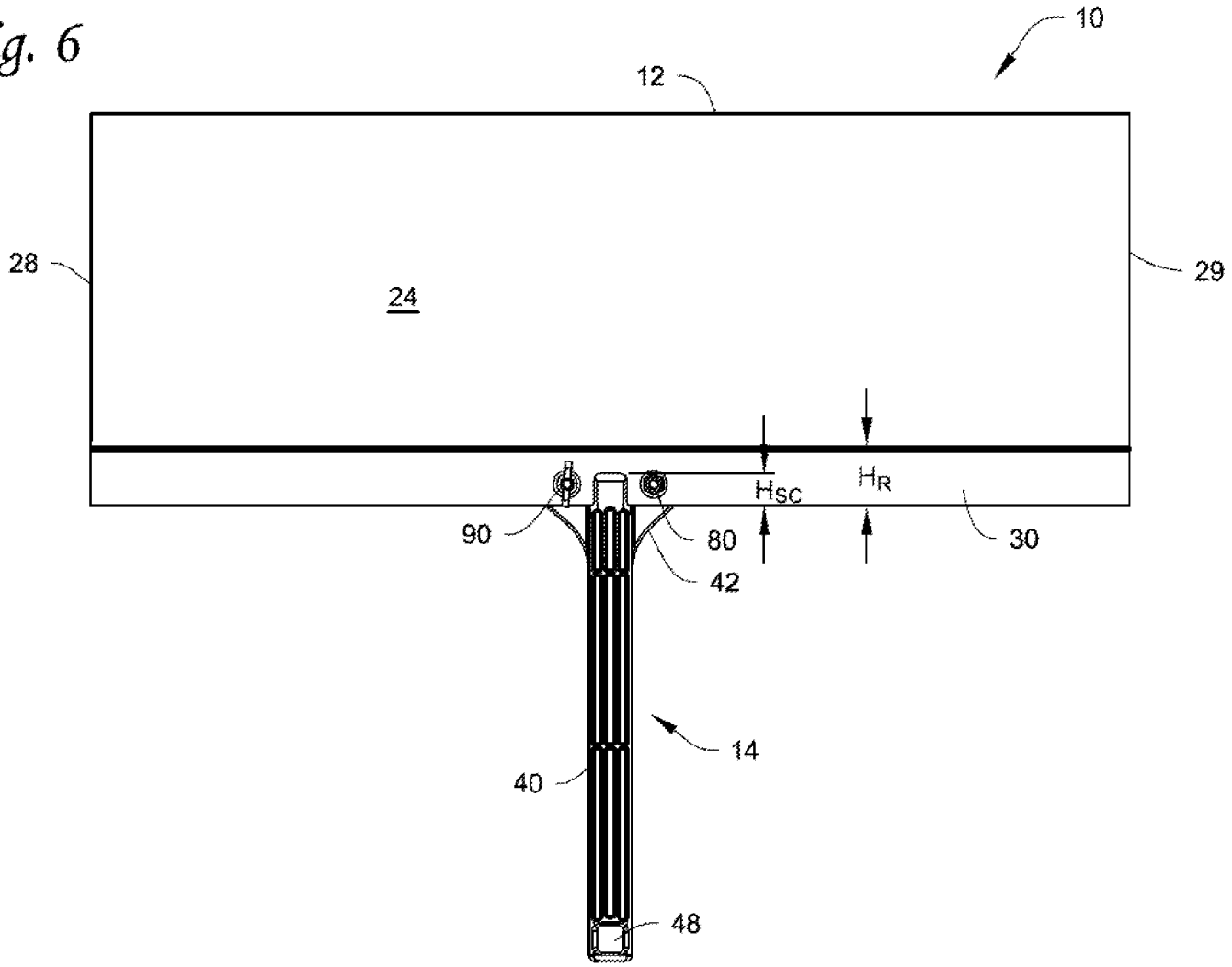
FIG. 6 is a rear view of the shield device of FIG. 5.

For example, as shown in FIGS. 1A-B and 2-8, a plurality of apertures 94, 104 are defined in the second side 66 or the distal side 70 of the first clamping member 50. If a perpendicular position is preferred, an aperture 94 (defined in the second side 66 of the first clamping member 50) can be selected to align with an aperture 96 defined in the attachment edge 20 of the sheet member 12, as shown in FIGS. 1B and 5-6. A bolt 92 can extend through the aligned apertures 94, 96, thereby forming a second attachment point 90. A wing nut 98 can be used to tighten the first clamping member 50 against the sheet member 12 such that the sheet member 12 is retained securely and releasably by the first clamping member 50.

Figure 7:
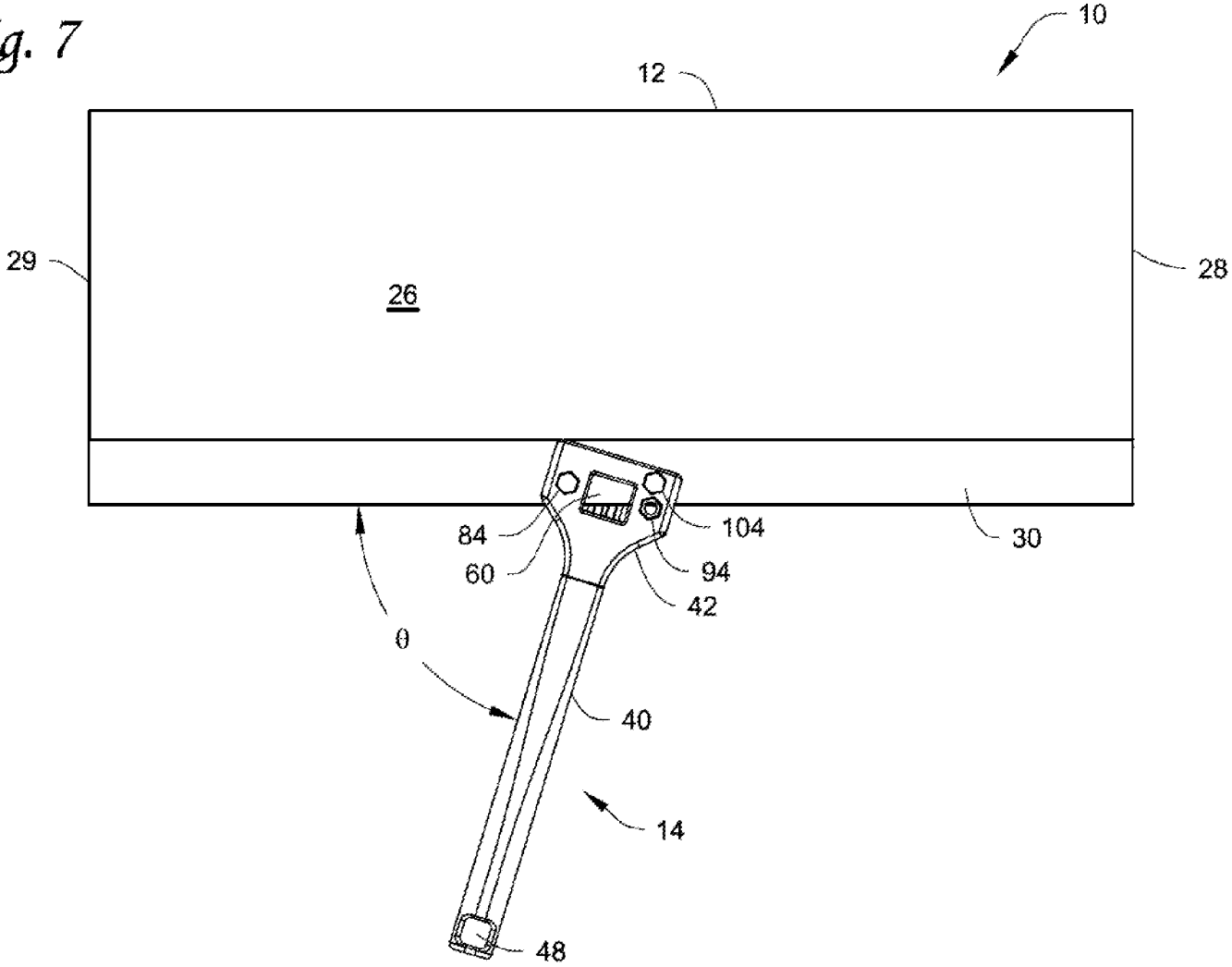
FIG. 7 is a front view of the shield device of FIG. 1, with the handle member being positioned in a second position, when the shield device is arranged in the second configuration.
Figure 8:
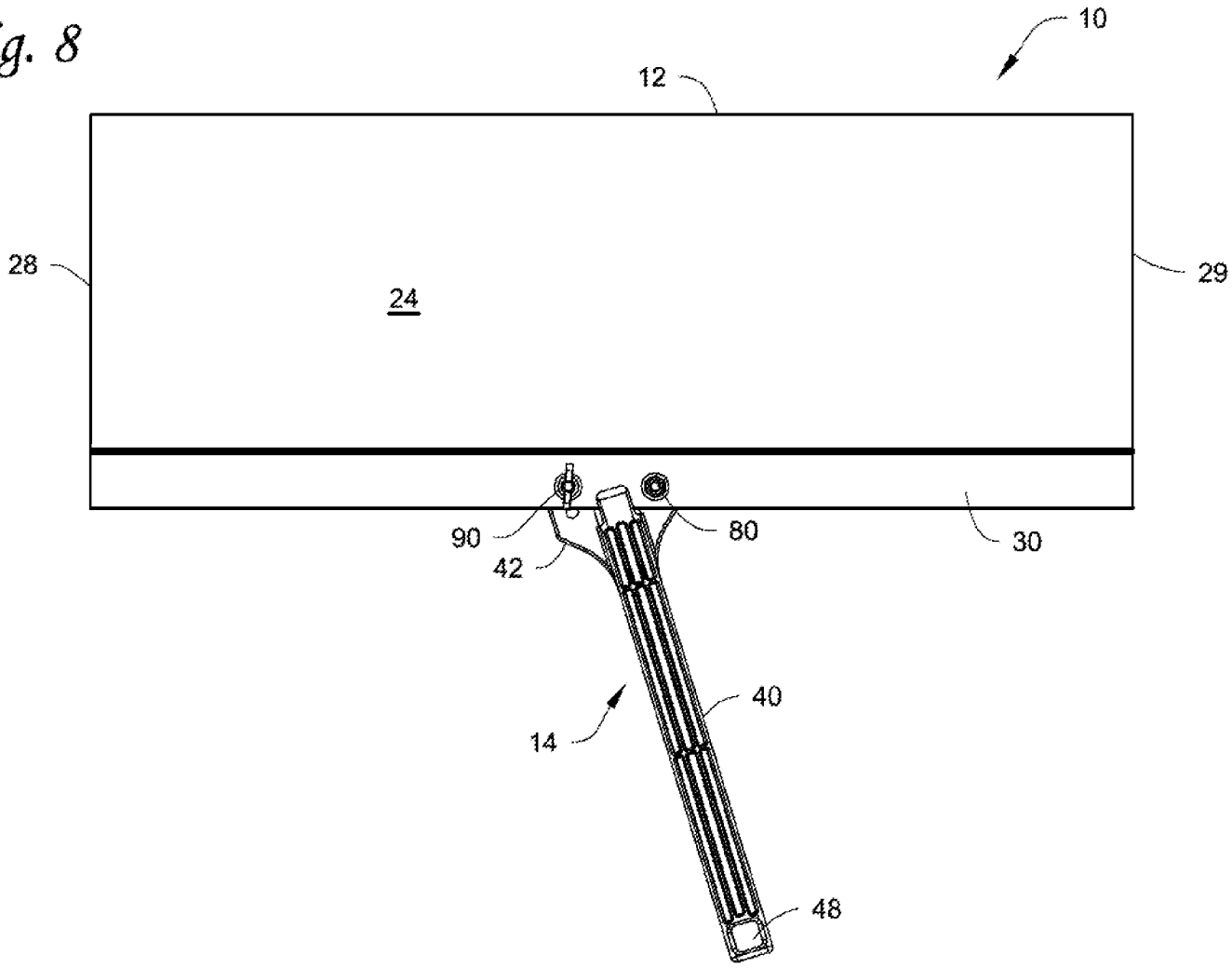
FIG. 8 is a rear view of the shield device of FIG. 7.

Referring now to FIGS. 1B and 7-8, if a non-perpendicular position is preferred, one or more apertures 104 (defined in the second side 66 of the first clamping member 50) can be selected to align with the aperture 96 defined in the attachment edge 20 of the sheet member 12. A bolt 92 can extend through the aligned apertures 104, 96, forming a second attachment point 90. A wing nut 98 can be used to tighten the first clamping member 50 against the sheet member 12 such that the sheet member 12 is retained securely and releasably by the first clamping member 50. In such circumstances, the handle member 14 is positioned at a non-perpendicular angle θ to the attachment edge 20. It is to be understood that the angle θ can vary as desired, ranging for example from 30 degrees to 150 degrees. In some embodiments, the aperture 104 is configured such that the angle θ is 75 degrees. It is to be understood that when multiple apertures 104 are defined in the first clamping member 50, the apertures 104 can be positioned such that multiple angles θ can be formed from 30 degrees to 150 degrees. In the depicted embodiment, the wing nut 98 is used to releasably secure the sheet member 12 to the connector element 42. However, it is to be understood that other fastening mechanisms can be used to releasably attach the connection element 42 to the attachment edge 20 at the second attachment point 90, such as knurled nut, threaded knob, quick release pin connector, pin and clip connector, or the like.

In the depicted embodiment, the bolt 82 may be secured against turning within the aperture 84 in the first clamping member 50 by appropriate means such as a countersunk recess defined in the first side 62 of the first clamping member 50, or equivalent manners. Additionally, a washer 110 can be used between a nut (or a wing nut) and the attachment edge 20. However, it is to be understood that various suitable fastening mechanisms can be used to attach the connection element 42 to the attachment edge 20.

A number of embodiments of the invention have been described. Nevertheless, it will be understood that various modifications may be made without departing from the spirit and scope of the invention. Accordingly, other embodiments are within the scope of the following claims.

The invention claimed is:

1. A shield device for protecting selected surface areas from being painted by a paint material, comprising:

a sheet member having a distal edge and an attachment edge parallel to each other, the sheet member configured to protect selected surface areas from being painted by paint material;

a handle member comprising a handle body, the handle member being pivotable in a plane defined by the sheet member, the handle member further comprising a first clamping member, a second clamping member and a slot defined between the first and second clamping members;

an attachment point about which the handle member is pivotable relative to the sheet member;

a fastener that attaches the first clamping member of the handle member to the attachment edge of the sheet member at the attachment point; and a reinforcement element attached to the attachment edge of the sheet member, wherein the slot is sized to receive a thickness of the reinforcement element, wherein the handle member is pivotable about the attachment point between a folded configuration and an unfolded configuration, and wherein the second clamping member of the handle member has a maximum width smaller than a width of the first clamping member such that the handle member is positioned generally parallel to and in contact with the reinforcement element, when the handle member is in the folded configuration, without removing the fastener to detach the first clamping member of the handle member from the reinforcement element and the sheet member.

2. The shield device of claim 1, wherein the handle member comprises a connection element that connects the handle member to the sheet member and the handle body extending between the connection element and a free end of the handle member, the connection element including the first clamping member, the second clamping member and the slot defined between the first and second clamping members.

3. The shield device of claim 2, wherein an interference fit is formed between the connection element and the reinforcement element.

4. The shield device of claim 2, wherein an opening is defined in the first clamping member, and the second clamping member has a contour corresponding to the contour of the opening in the first clamping member.

5. The shield device of claim 2, wherein the first clamping member includes a plurality of apertures, each of the apertures being alignable with corresponding apertures defined in the attachment edge of the sheet member and the reinforcement element, thereby allowing the handle member to be positioned at a perpendicular position and a non-perpendicular position relative to the sheet member.

6. The shield device of claim 2, wherein the second clamping member has a constant width that is smaller than a constant width of the handle body.

7. The shield device of claim 2, wherein the second clamping member has a constant width that is smaller than a width of a distal end of the handle body.

8. The shield device of claim 2, wherein the second clamping member has a maximum width that is smaller than a constant width of the handle body.

9. The shield device of claim 1, wherein a height of the second clamping member is equal or greater than ⅓ of a height of the reinforcement element.

* * * * *